United States Patent [19]

Muldoon

[11] Patent Number: 4,620,431

[45] Date of Patent: Nov. 4, 1986

[54] GOLF CLUB STRAIGHTENING DEVICE

[76] Inventor: Douglas P. Muldoon, 26321 Wilson, Dearborn Heights, Mich. 48127

[21] Appl. No.: 800,422

[22] Filed: Nov. 21, 1985

[51] Int. Cl.[4] ..... B21C 51/00

[52] U.S. Cl. ..... 72/31; 72/35; 72/459

[58] Field of Search ..... 72/31, 32, 33, 34, 35, 72/290, 301, 310, 459

[56] References Cited

U.S. PATENT DOCUMENTS

| | | | |
|---|---|---|---|
| 2,953,048 | 9/1900 | Brown | 72/35 |
| 3,194,038 | 7/1965 | Small | 72/35 |
| 3,357,219 | 12/1967 | Hunter | 72/35 |
| 3,388,575 | 6/1968 | Fuzere | 72/35 |
| 3,439,429 | 4/1969 | Sundstrom | 33/174 |
| 3,965,714 | 6/1976 | Beard | 72/32 |
| 4,094,072 | 6/1978 | Erb | 72/293 |

*Primary Examiner*—Leon Gilden
*Attorney, Agent, or Firm*—Hauke & Patalidis

[57] ABSTRACT

Inprovement in a golf club straightening device for straightening golf club irons, the device having a base, an arrangement for clamping the head of the golf club iron, an arrangement for examining the loft of the golf club iron, and an arrangement for examining the lie of the golf club iron, the improvement comprising an arcuate loft arm mounted stationary in respect to the base and upstanding therefrom, a swingarm mechanism comprising a pivot support stationary in respect to the base and upstanding therefrom and including a bifurcated swingarm pivotally mounted on the pivot support, upper and lower clamps moveably carried on the bifurcated swingarm for clamping the head of a golf club iron so that the front face thereof is flat against the rear face of the bifurcated swingarm, the swingarm being pivotally moveable in respect to the arcuate loft arm and being capable of being made fast in respect thereto by being clamped thereagainst, the arcuate loft arm having an angular scale thereon for determining the loft of the golf club.

14 Claims, 10 Drawing Figures

FIG. 3
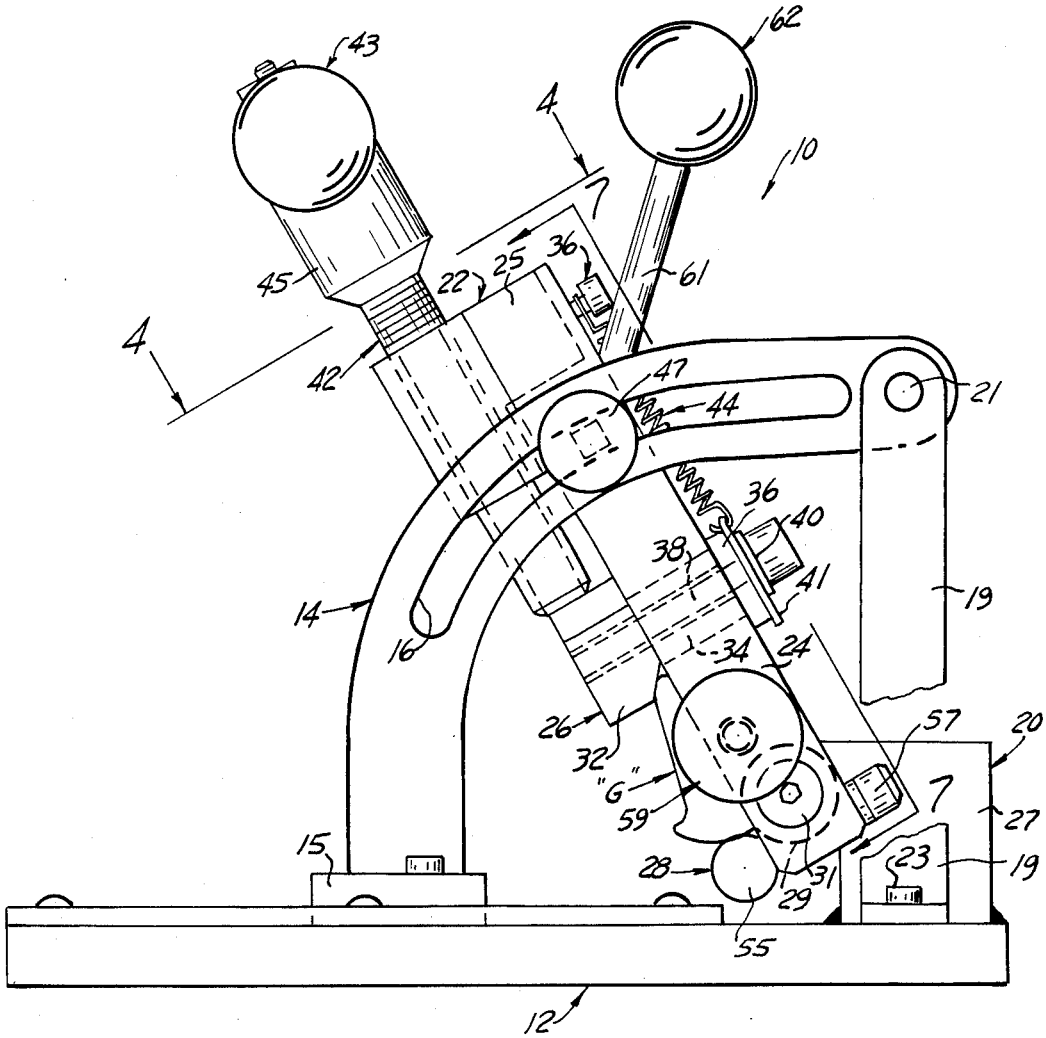
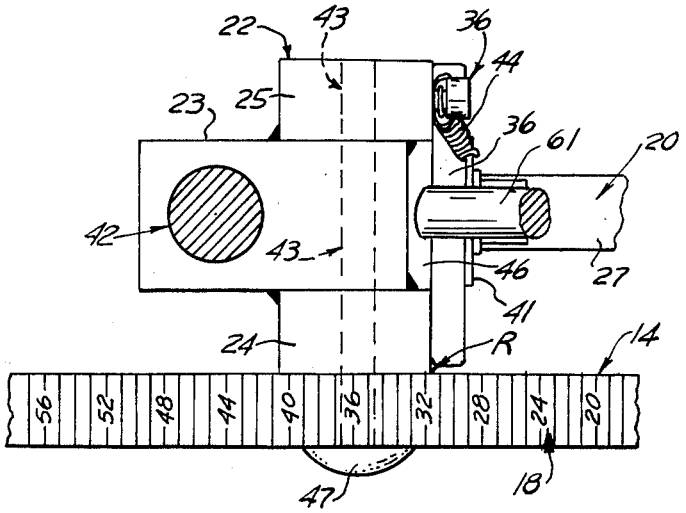
FIG.6

GOLF CLUB STRAIGHTENING DEVICE

BACKGROUND OF THE INVENTION

The present invention relates to a golf club straightening device for straightening golf club irons. The principal object of the present invention is to provide improvements in golf club straightening devices which include a bifurcated swingarm for carrying clamping means for clamping the club head and an arcuate loft arm for measuring the angular position of the swingarm and hence the loft of the club and a slidable angled bracket carrying a pointed lie plate for measuring the angular position of the club shaft and hence the lie of the club.

THE PRIOR ART

Many prior art devices have been proposed for straightening golf clubs, such as U.S. Pat. No. 2,973,581 to Rhodehamel and U.S. Pat. No. 3,439,429 to Sundstrom, but in respect to the present invention, these are deficient concerning the ease, accuracy and reliability of straightening of golf club irons, particularly in the means for clamping the head of each golf club iron and for examining the loft and lie thereof.

SUMMARY OF THE INVENTION

The present invention provides improvements in a golf club straightening device for straightening golf club irons, either left hand or right hand irons, and is particularly designed to precisely position the head of a golf club iron and to hold it firmly on a bifurcated swingarm which is swingable in relation to an arcuate loft arm and which holds the club shaft in an angular position in respect to a pointed lie plate carried on a slidable angled bracket. The bifurcated swingarm holds upper and lower individually moveable clamping means for clamping the head of a golf club iron and provides a sight opening between the bifurcations thereof for proper positioning of the club head preparatory to clamping.

BRIEF DESCRIPTION OF THE DRAWINGS

The foregoing object of the present invention and the advantages thereof will become apparent during the course of the following description, taken in conjunction with the accompanying drawings, wherein like reference characters designate like parts in the several views and in which:

FIGS. 1, 2 and 3 are, respectively, top left perspective, front elevational and left side elevational views of a golf club straightening device embodying the present invention;

FIG. 6 is a fragmentary plan view of a portion of the structure of FIG. 3 taken on the line 6—6 thereof;

DESCRIPTION OF THE PREFERRED EMBODIMENT

Figure 9:
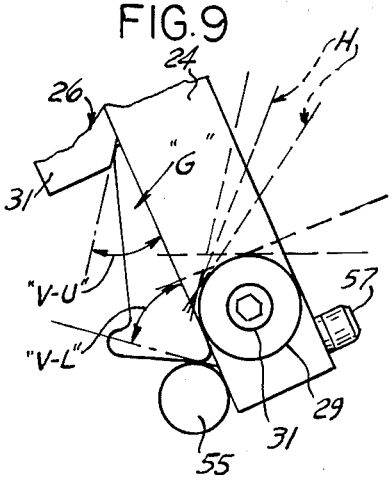
FIG. 9 is a fragmentary side elevational view of a portion of the structure of FIG. 3.
Figure 4:
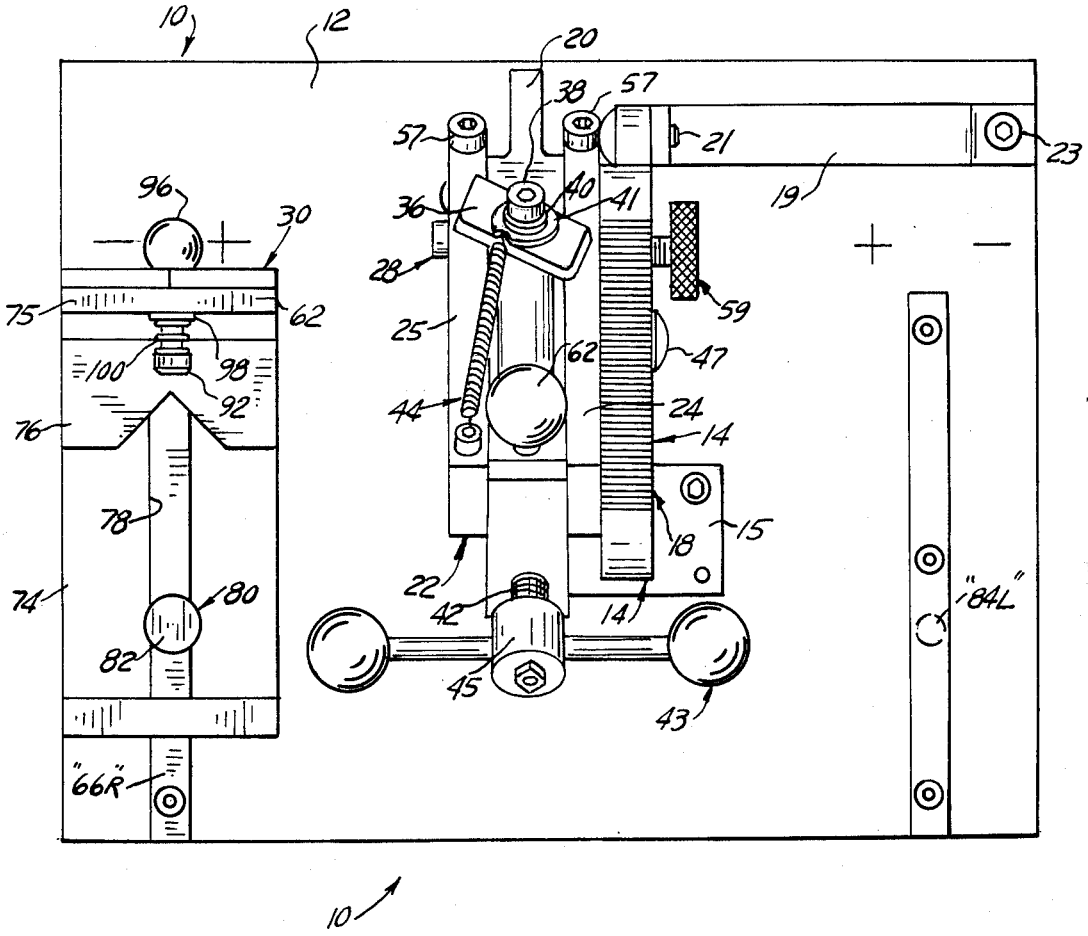
FIG. 4 is a top plan view of said embodiment with the rear edge of the base of the device disposed at the bottom of the Figure.
Figure 7:
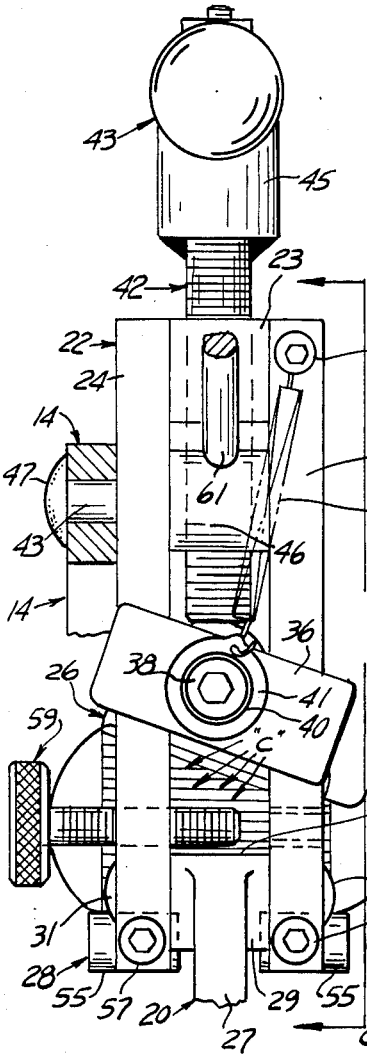
FIG. 7 is a fragmentary, substantially vertical sectional view of a portion of the structure of FIG. 3 taken on the line 7—7 thereof.

Referring to the drawings in greater detail, 10 generally designates a golf club straightening device embodying the present invention which comprises a base 12 having stationarily mounted thereon an arcuate loft arm 14 for checking the loft of a golf club iron. The arcuate loft arm 14 is welded at its lower end to a subbase 15 which, in turn, is bolted, as shown, to the base 12. At its upper front end, the arcuate loft arm 14 is held by a brace 19 to which it is bolted, as at 21. The brace 19 is disposed at an acute angle to the base 12 and its lower end is bolted thereto, as at 23. The loft arm 14 has an arcuate slot 16 therein and on the top surface thereof a scale 18, FIG. 4, is engraved in angular degrees (in increments of one degree each) from zero to seventy. A swingarm mechanism is provided having a pivot support 20 welded to the base 12 and a bifurcated swingarm 22 pivotally mounted on the pivot support 20, the bifurcations of which are designated 24 and 25, respectively. The upper ends of the bifurcations are solidly joined together by a block 23 welded to the bifurcations 24, 25. The pivot support 20 is in the form of an upstanding plate 27 welded to the base 12, as shown, and a cylindrical member 29 welded to the plate 27 which extends left to right (and vice versa) and fills the space between the bifurcations 24, 25 at the lower end thereof, as shown. An axle 31 extends through a central aperture in the member 29 and is rotatably supported thereby; the axle 31, in turn, is made fast to the swingarm 22, as shown, and rotatably supports the latter on the pivot support 20. The cylindrical shape of the member 29 is important as its top surface (designated "T" in FIG. 7) always presents horizontal sight lines (indicated at "H" in FIG. 9) when viewing the golf club face irrespective of the vertical distance from which the angle of sight originates. During clamping of a golf club, designated "G", the horizontal sight line "T" is used to sight the corrugations "C" (FIG. 7) in the face of the club head and maintain them horizontal which is critical to proper positioning of the golf club "G" to be straightened.

For clamping the head of a golf club iron, the bifurcated swingarm 22 carries thereon upper and lower clamp means designated 26 and 28, respectively, which clamp the club head so that its front face is flat against the rear face of the bifurcated swingarm 22. Such clamp means 26, 28 will be referred to in greater detail hereinafter. For examining the lie of a golf club, the golf club straightening device 10 also includes a pointed lie plate 30 which is both pivotally and slidably carried on a slidable angled bracket 73 slidably mounted on the base 12 for movement front to back thereof, as shown.

Figure 8:
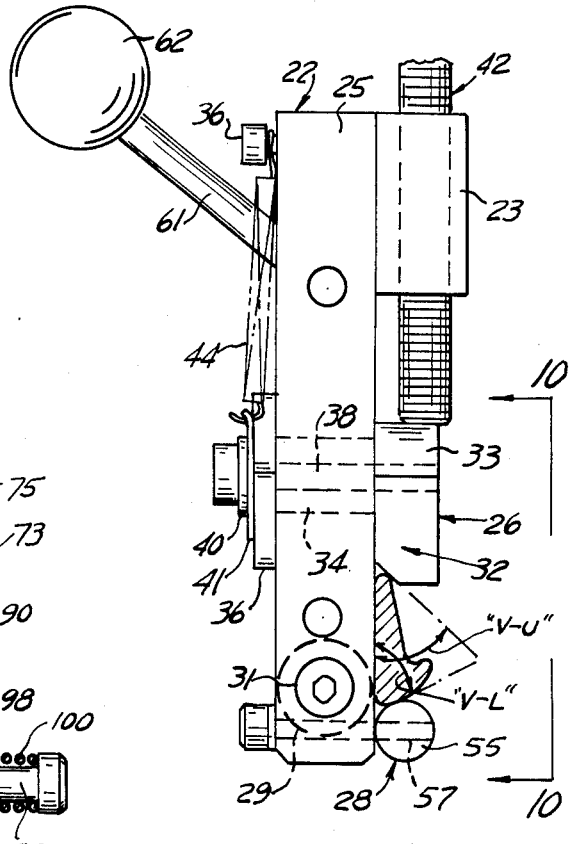
FIG. 8 is a substantially vertical sectional view of the structure of FIG. 7 taken on the line 8—8 thereof.
Figure 5:
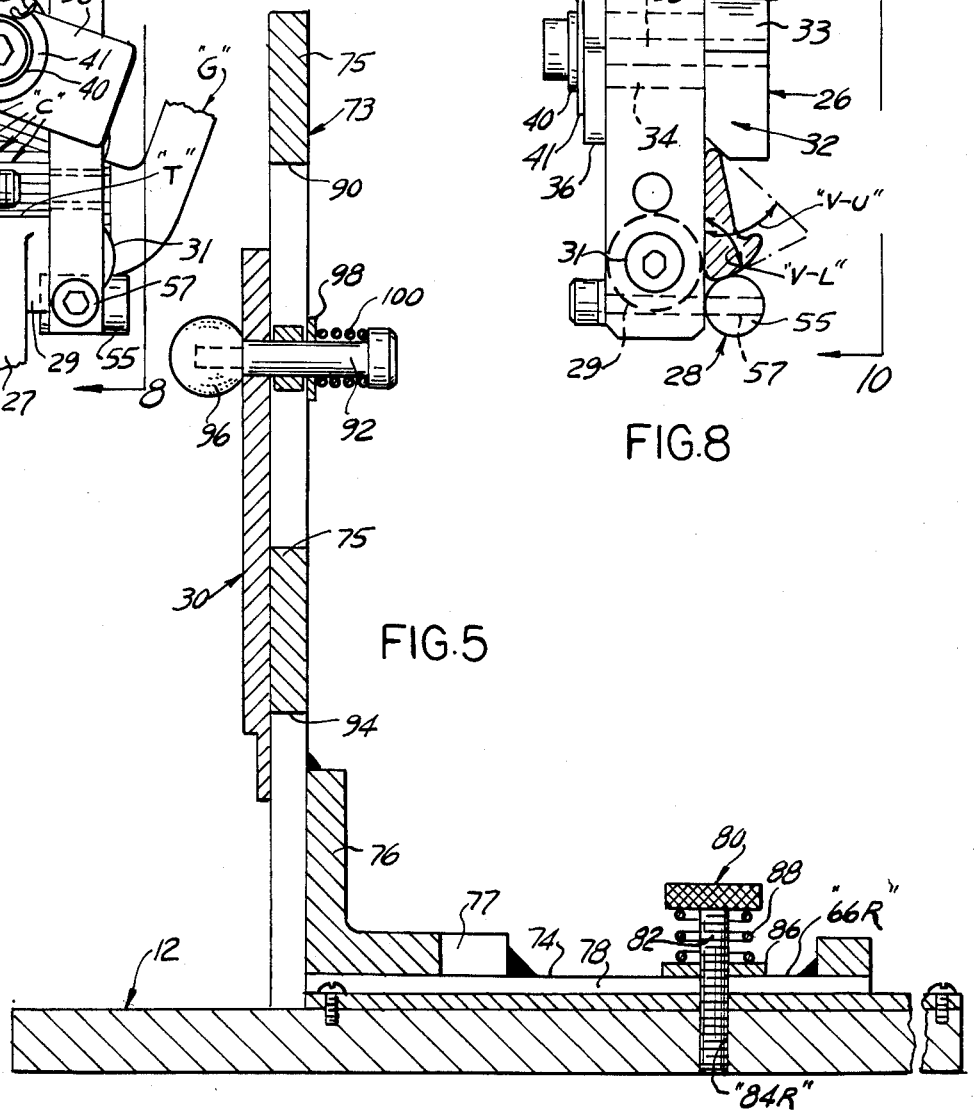
FIG. 5 is a vertical sectional view of the structure of FIG. 2 taken on the line 5—5 thereof.

The upper clamp means 26 consists of a moveable clamp head 32 which moves while bearing against the back face of the swingarm 22 and is made fast to an end of a bolt 38 which extends front to back through the bifurcations 24, 25. Also made fast on the other end of the bolt 38 is a plate 36 which bears against the front face of the swingarm 22. A pipe 34 is disposed about the shaft of the bolt 38 and extends front to back between the bifurcations 24, 25, as shown. The head of the bolt 38 bears against two washers 40 and 41 which are clamped between the front face of the plate 36 and the head of the bolt 38. The upper clamp means 26 includes a worm screw 42 threadably supported in a rearward extension of the block 23, as shown, so that its lower operative end can press down upon the top of the clamp head 32. The head 32 has a semi-cylindrical protuberance 33 on the upper surface thereof for engagement with the lower end of the worm screw 42 to accommodate vaired rotational positions of the clamp head 32. The worm screw 42 is manually rotatable via a double-knobbed handle 43, as shown. The handle 43 includes a rod, as shown, which is slidable in an enlargement 45 formed on the upper end of the worm screw 42. The washer 41 is crimped and pierced, as shown, to serve as an anchor for the lower end of a tension spring 44, the upper end of which is anchored, as at 36, to the upper end of the bifurcation 25, as shown. The spring 44 yieldably biases the clamp head 32 upwardly and maintains it yieldably engaged against the lower operative end of the worm screw 42. By the arrangement thus described, the clamp head 32 is able to rotate approximately 180 degrees about the axis of the shaft 34. In addition, the clamp head 32 is able to move vertically and horizontally between the confines of the bifurcations 24, 25. In other words, the clamp head 32 is substantially universally moveable a predetermined distance vertically and a predetermined distance horizontally to adjust to the angular disposition of the upper edge of the particular golf club head being clamped, that is, its central axis is freely moveable both vertically and horizontally, while the head itself can assume any angular position in respect to the base 12. The lower inside edge of the upper clamp head 32 is notched, as shown, to form a V-shaped groove (designated "V-U") with the rear face of the swingarm 22, as shown in FIG. 8. The upper edge of the club G is held in the groove "V-U" during clamping thereof.

The lower clamp means consists of a pair of cylindrical or round members 55 which are bolted, as at 57, to the rear faces of the bifurcations 24, 25 respectively. Each round member 55 is made to freely rotate about the axis of its respective holding bolt 57. The round members 55 form a V-shaped groove (designated "V-L") with the back face of the swingarm 22 for clamping therein the lower front edge and the sole of the golf club iron G. By being freely independently rotatable, the round members 55 are capable of adjusting their rotational positions to accommodate the particular disposition and shape of the lower front edge and sole of the head of the golf club G to be examined.

A large-head bolt 59 is threadably carried in one of the bifurcations 24, 25 so as to project laterally therefrom. The large-head thereof bears against the toe of the club head being clamped (FIG. 7) to prevent movement of the latter during application of clamping pressure to the club head via downward movement of the clamp head 32. A pair of threaded apertures 56, 58 is provided in the bifurcations 25, 26, respectively, for threadably engaging the bolt 59. The aperture 56 in the bifurcation 24 is used for right-hand clubs (as is the case in the instance shown) and the aperture 58 in the bifurcation 25 for left-hand clubs.

As the bifurcated swingarm 22 rotates about the pivot support 20, the left side of the bifurcation 24 slidably engages the inside surface of the arcuate loft arm 14 so that the angular position of the bifurcated swingarm 22 can be read off the scale 18 by sighting the corner R (FIG. 6) formed by the front face of the bifurcation 24 where it intersects the scale 18. A bolt 43 extends left to right through the arcuate slot 16 in the loft arm 14 and through clearance apertures in the bifurcations 24, 25, as shown, and has its head 47 bearing against the outside surface of the loft arm 14. A locking nut 46 is provided which threadably engages the bolt 43 and locks the bifurcated swingarm 22 in any of its angular positions to hold it fast against the loft arm 14 whenever the locking nut 46 is tightened. The locking nut 46 extends the full distance left to right (or vice versa) between the bifurcations 23, 24 and has a rod 61 projecting forwardly of the bifurcated swingarm 22. The free end of the rod 61 has made fast thereto a substantially spherical knobbed handle, as shown, which is designated 62. Limited rotation of the locking nut 46, effected via the handle 62, rotates it between full lock and full unlock positions for quick adjustment of the angular position of the swingarm 22.

The angled bracket 73 consists of a plate 74 that slides flat on the base 12 and a plate 75 which is made fast to the plate 60 and upstands therefrom at right angles thereto. A reinforcing bracket 76 which is notched, as at 77, is welded, as shown, to the two plates 74 and 75. The plane of the front face of the plate 75 is parallel to the plane of the front face of the base 12. The plate 74 has a slot 78 therein that receives and cooperates with an upstanding bar 66R made fast to the base 12 for guiding the sliding movement of the angled bracket 73 in a direction front to back of the base 12. A holding device 80 is provided (for holding the angled bracket 73 snugly in any of its slidable positions front to back in respect to the base 12) consisting of a large-head bolt 82 (threadably engaged in a threaded aperture 84R in the base 12), a washer 86 and a compression spring 88 operative between the head of the bolt 82 and the washer 86. By this means, a holding force is applied to the washer 86 to snugly hold the plate 74 between said washer 86 and the base 12 so that the angled bracket 73 will remain fast against sliding movement in whatever position to which it is manually slid. The plate 75 has an upper slot 90 therein through which a shaft 92 extends for pivotably supporting the pointed lie plate 30. The plate 75 also has a lower slot 94 therein which is vertically spaced from and below the slot 90; the slot 94 is a continuation of the slot 78 in the plate 74 and serves as a read-out means for the lie angle of the club being examined as will be mentioned hereinafter. The shaft 92 has a head thereon, as shown, and itself extends through the slot 90 and through an aperture, as shown, in the pointed lie plate 30. The end of the shaft 92 opposite its head is reduced in diameter and threaded, as shown, to threadably engage a substantially spherical knobbed nut 96 which bears against the front face of the pointed lie plate 30. A washer 98 bears against the rear face of the plate 75 and a compression spring 100 which encircles the shaft 92 operates between the head thereof the washer 98 for yieldably forcing the pointed lie plate 30 against the front face of the plate 75. Tightening of the knobbed nut 96 holds the pointed lie plate 30 in any of its adjusted positions on the plate 75. Thus the pointed lie plate 30 can assume any vertical position over the length of the slot 90 (since the shaft 92 is freely moveable vertically therein) and any angular position in respect to the horizontal (since it is freely rotatable about the shaft 92).

The top end of the pointed lie plate 30 forms a sixty degree included angle, as shown, and the bottom end has a reduced thickness portion, as shown, which is engraved with two scales "P" and "N" each in angular degrees from zero to nine of one degree increments which are read by intersection, respectively, with the left and right vertical edges of the slot 94. The left scale "P" is positive and the angular degrees read thereon are added to 60 degrees (the included angle of the lie plate 30) to arrive at the lie of the golf club being examined. The right scale "N" is negative and the angular degrees read thereon are subtracted from 60 degrees to arrive at such lie.

The device 10 is shown arranged for straightening right hand golf club irons, but the same is also capable of straightening left hand irons. For this purpose, the base 12 is provided on the left side thereof with a threaded aperture 84L therein and a second guide bar 66L, whereby the holding device 80 and the angled bracket 73 can be removed from engagement with the guide bar 66R and can be transferred to the left side of the base 12 so that the plate 74 can slide, via its slot 78, over the guide bar 66L and so that the threaded shank of the bolt 82 of the holding device 80 can threadably engage the aperture 84L. Also, the large head bolt 59 can be removed from the threaded aperture 56 in the left bifurcation 24 of the swingarm 22 and transferred to the right bifurcation 25 thereof and can be threadably engaged in the threaded aperture 58 therein, whereby to serve as an abutment for the toe end of a left hand club head during clamping thereof by the upper and lower clamp means 26, 28. For straightening left-handed golf clubs, the previously mentioned brace 19 must be detached from the base 12 and from the loft arm 14; if needed, a similar brace (not shown) can be attached to the base 12 and to the right side of said loft arm 14.

Figure 1:
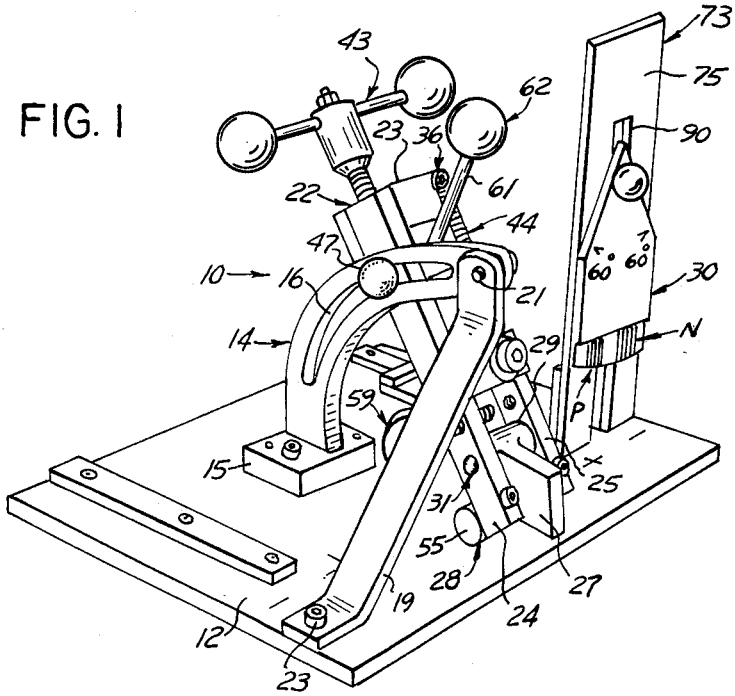
Figure 2:
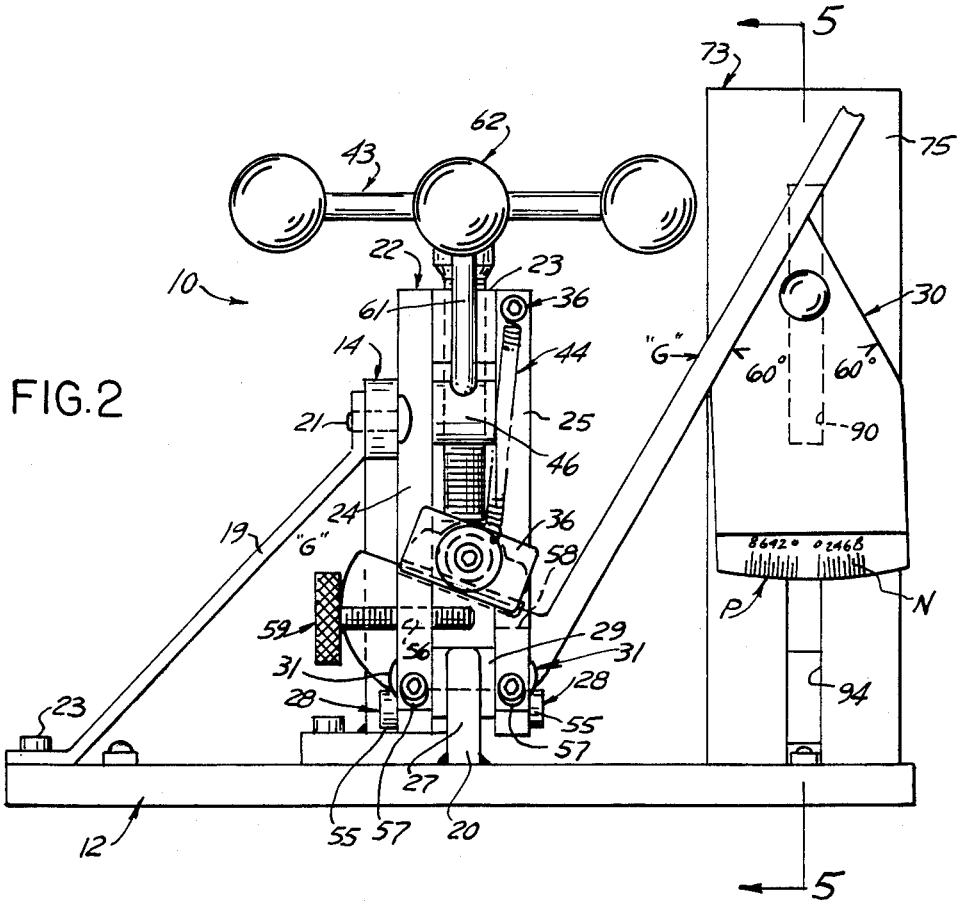
Figure 10:
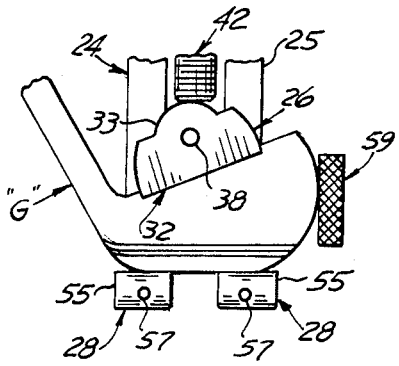
FIG. 10 is a fragmentary, substantially vertical sectional view of a portion of the structure of FIG. 8 taken on the line 10—10 thereof.

In operation of the golf club straightening device 10, each one of a set of golf club irons (consisting of irons from 1 through 9, a wedge, sand iron and putter) is first individually inserted in the device 10 for examination for both loft and lie. The two readings of both loft and lie for each club (save for the putter) are recorded. (Only one reading for the putter is made, i.e., the lie thereof). Any given club "G" is examined by inserting the club head thereof beneath the clamp head 32 with its front face flat against the rear face of the swingarm 22 and with its bottom edge and sole inserted into the V-pocket "V-L" formed by the pair of round members 55. If necessary, the round members 55 rotate individually about their respective pivot axes 57 to accommodate the shape and position of the bottom edge and sole of the particular club head being examined. The clamp head 32 is then lowered until the upper edge of the club head enters the V-pocket "V-U" formed by the clamp head 32. With the golf club head lightly clamped by the clamp head 32, the corrugations "C" on the front face thereof are sighted via the previously mentioned top surfact "T" on the cylindrical member 29 to insure that they are maintained horizontal during clamping of the golf club "G". The large head of the bolt 59 is then brought to bear against the toe of the club head to be examined. Then the clamping force on the clamp head 32 is gradually increased by slowly turning the worm screw 38 until the head of the golf club "G" to be examined is securely clamped on the swingarm 22 with the corrugations "C" thereof exactly horizontal. The angled bracket 73 is made to slide snugly by adjustment of the holding device 80 so that such bracket 73 will remain stationary in any position (front to back in respect to the base 12) to which it is slid. The golf club "G" being examined is then made to assume a predetermined position in respect to the base 12 by simultaneously pivoting the swingarm 22 and moving the angled bracket 73 front to back of the base 12 until the rear edge of the shaft of the golf club "G" lies flat against the front face of the plate 75. The swingarm 22 is then made fast to the loft arm 14 by tightening of the nut. The loft of the club is read off the scale 18 where intersected by the front face of the left bifurcation 24 as indicated at R (FIG. 6). The pointed lie plate 30 is then moved vertically in the slot 90 and rotated about the shaft 92 until (for a right-hand golf club) the left angled edge thereof lies flat against the right or outside edge of the shaft of the golf club, as shown in FIG. 2. The positive or negative scale "P" or "N" on the bottom edge of the lie plate 30 will intersect with either the left or right edge of the slot 94 so that an angle measurement (from zero to 9 degrees) can be read off from one or the other of the scales "P" or "N". Such angle measurement is then added (if on the positive scale), or subtracted (if on the negative scale), from 60 degrees to arrive at the lie of the golf club "G". The loft and lie is thus determined for each of the golf clubs of the set. After the loft and lie readings are taken for the complete set of irons, the plurality of readings are compared with each other from which comparison it is then determined (by the user of the device 10 who is usually a golf professional having responsibility of the straightening of the set of golf clubs) whether any adjustment is necessary in either the loft or lie or both of any of the clubs of the set of golf clubs thus checked. If an adjustment or straightening is necessary, the hosel of the club is bent, as is well known, with a suitable tool while the head of the club is held firmly clamped, as described, and the loft desired, as shown on the scale 18, is imparted thereto. Likewise, if an adjustment or straightening in the lie of the club is desired, the hosel of the club is bent, as is well known, with the same tool while the head of the club is held firmly clamped as described, and the lie desired as shown by the applicable lie scale ("P" or "N") is imparted thereto. During imparting of the proper lie to the golf club, (for a right-hand club), the bending of the hosel is made so that the rear edge of the shaft of the golf club lies flat against the front face of the plate 75 when the left edge of the pointed lie plate 30 (while reading the desired lie) lies flat against the outside or right edge of the shaft of the golf club. It will thus be seen that there has been provided by my invention a golf club straightening device in which the object hereinabove set forth, together with many thoroughtly practical advantages, has been successfully achieved. While a preferred embodiment of the invention has been shown and described, it will be understood that variations and changes may be resorted to without departing from the spirit of the invention as defined by the appended claims.

What is claimed is:

1. Improvement in a golf club straightening device for straightening golf club irons, said device having a base, means for clamping the head of the golf club iron, means for examining the loft of the golf club iron, and means for examining the lie of the golf club iron, said improvement comprising an arcuate loft arm mounted stationary in respect to the base and upstanding therefrom, a swingarm mechanism comprising a pivot support stationary in respect to the base and upstanding therefrom and including a bifurcated swingarm pivotally mounted on said pivot support, upper and lower clamp means moveably carried on said bifurcated swingarm for clamping the head of a golf club iron so that the front face thereof is flat against the rear face of said bifurcated swingarm, said swingarm being pivotally moveable in respect to the said arcuate loft arm and being capable of being made fast in respect thereto by being clamped thereagainst, said arcuate loft arm having an angular scale thereon for determining the loft of said golf club.

2. Improvement in a golf club device as claimed in claim 1 further comprising a bracket slidable on said base front to back thereof having an upright plate upstanding from the base, the plane of said upright plate being parallel to the plane of the front face of the base, and a pointed lie plate moveably carried on said upright plate, the rear edge of golf club shaft being capable of lying flat against the front face of said upright plate, and the outside edge of said golf club shaft being capable of lying flat against an edge of the pointed end of said lie plate, said lie plate having an angular scale thereon for ascertaining the angular position, if any, of said pointed lie place, whereby to determine the lie of said golf club.

3. Improvement in a golf club straightening device as claimed in claim 1 in which said upper and lower clamp means form upper and lower substantially V-shaped pockets, respectively, with the rear face of said swingarm.

4. Improvement in a golf club straightening device as claimed in claim 1 in which said pivot support includes a cylindrical member extending between the bifurcations of said bifurcated swingarm left to right and vice versa, so as to provide a horizontal sight line for sighting the horizontal corrugations on the front face of the head of said golf club iron when the latter is being positioned on said swingarm prior to being firmly clamped in respect thereto.

5. Improvement in a golf club straightening device as claimed in claim 1 in which the upper clamp means consists of a clamp head and a shaft, the clamp head being made fast to said shaft, the shaft extending front to back between said bifurcations, said clamp head rotatable about the center of said shaft over a range of about 180 degrees, the center of the clamp head moveable both vertically and horizontally between the confines of said bifurcations.

6. Improvement in a golf club straightening device as claimed in claim 1 in which said lower clamp means consists of a pair of cylindrical members rotatably carried, respectively, on the rear faces of the bifurcations of said bifurcated swingarm, said cylindrical members being each independently freely rotatable in respect to the bifurcations on which they are carried, whereby to adjust their rotational positions to accommodate the bottom edge and sole of the head of the golf club to be examined.

7. Improvement in a golf club straightening device as claimed in claim 1 in which said upper clamp means includes a worm screw moveably supported on the upper end of said bifurcated swingarm for pressing down upon said moveable clamp head.

8. Improvement in a golf club straightening device as claimed in claim 7 in which said clamp head has a semi-cylindrical protuberance on the top surface thereof for engaging the lower operative end of the worm screw, whereby to accommodate the plurality of angular positions of said clamp head in respect to the horizontal.

9. Improvement in a golf club straightening device as claimed in claim 7 in which said upper clamp means includes yieldable means operative upon said clamp head for yieldably urging it against the operative lower end of said worm screw.

10. Improvement in a golf club straightening device as claimed in claim 1 in which a manually operated single lever locking device is provided for locking the bifurcated swingarm against the arcuate loft arm to hold or release said swingarm in respect to its different angular positions relative to the base.

11. Improvement as claimed in claim 2 in which said upright plate is slotted vertically and a shaft extends through the slot therein, said shaft moveable vertically in said slot, said pointed lie plate pivotally carried on said shaft.

12. Improvement as claimed in claim 11 in which yieldable means operative upon said last-mentioned shaft are provided for yieldably holding the rear face of the pointed lie plate tight against the front face of said upright plate.

13. Improvement as claimed in claim 1 further comprising abutment means for the toe end of the club head for holding the latter against horizontal movement when same is being clamped in said device.

14. Improvement as claimed in claim 12 in which said abutment means is in the form of a large headed screw threaded in one of said bifurcations and projecting laterally from a side thereof.

* * * * *